US005474377A

United States Patent [19]

Cone et al.

[11] Patent Number: 5,474,377

[45] Date of Patent: Dec. 12, 1995

[54] MOVABLE STORAGE CONTAINER

[75] Inventors: Richard E. Cone, Athens, Ohio; Dennis M. Turner, Scipio, Ind.

[73] Assignee: Cosco, Inc., Columbus, Ind.

[21] Appl. No.: 129,659

[22] Filed: Sep. 30, 1993

[51] Int. Cl.[6] ..... A47B 88/00

[52] U.S. Cl. ..... 312/326; 5/308; 312/237; 248/131

[58] Field of Search ..... 5/308, 931; 108/42, 108/49, 104, 103; 312/326, 329, 237, 249.2, 249.3; 248/315, 289.1, 131, 132

[56] References Cited

U.S. PATENT DOCUMENTS

| | | | |
|---|---|---|---|
| 171,940 | 1/1876 | Kramer . | |
| 188,593 | 3/1877 | Coleman . | |
| D. 234,385 | 2/1975 | Turner | D6/80 |
| 390,815 | 10/1888 | Strong . | |
| 525,436 | 9/1894 | Whiteside . | |
| 599,921 | 3/1898 | Stenhouse . | |
| 618,264 | 1/1899 | Burtless . | |
| 661,626 | 11/1900 | Stenhouse . | |
| 685,079 | 10/1901 | Wilmot . | |
| 931,304 | 8/1909 | Henning . | |
| 1,431,299 | 10/1922 | Godsell | 5/308 |
| 1,580,163 | 4/1926 | Peterson et al. | 248/131 |
| 2,610,329 | 9/1952 | Strathaus . | |
| 2,679,653 | 6/1954 | Blanke et al. . | |
| 3,711,875 | 1/1973 | Cox | 5/2 |
| 4,110,854 | 9/1978 | Sjolie | 5/2 R |
| 4,195,882 | 4/1980 | Daswick et al. . | |
| 4,597,122 | 7/1986 | Handler et al. | 5/503 |
| 4,780,919 | 11/1988 | Harrison | 5/60 |
| 5,070,556 | 12/1991 | Gloger | 5/308 |
| 5,107,553 | 4/1992 | Mizrahi . | |

FOREIGN PATENT DOCUMENTS

| | | |
|---|---|---|
| 679519 | 1/1930 | France . |

*Primary Examiner*—Kenneth J. Dorner
*Assistant Examiner*—Gerald A. Anderson
*Attorney, Agent, or Firm*—Barnes & Thornburg

[57] ABSTRACT

A movable storage container is provided for use under a piece of furniture having at least one leg. The container includes a frame, a basket mounted on the frame for movement therewith, and a hinge. The basket is formed to include an item-storage region therein. The hinge is formed to pivot about an axis of a leg of a piece of furniture and coupled to the frame so that the frame end basket are movable as a unit relative to the piece of furniture about the leg.

42 Claims, 3 Drawing Sheets

MOVABLE STORAGE CONTAINER

BACKGROUND AND SUMMARY OF THE INVENTION

This present invention relates to storage containers and, particularly, to a movable storage container. More particularly, the present invention relates to a movable storage container for use under a piece of furniture having at least one leg.

Storage containers are generally well-known items and are currently in widespread use. However, it is also known that storage containers may be movable and attached to a bed. See, for example, U.S. Pat. Nos. 5,070,556 to Gloger and 618,264 to Burtless. Although storage containers which are mounted under beds are known, it would be desirable to provide an alternative storage container that is simpler to use and less expensive to manufacture.

People often fail to maximize the available storage space beneath their beds. This failure is most likely due to either the inconvenience associated with dragging bulky storage boxes from underneath the bed or to the expense associated with purchasing a new bed frame formed to accommodate underlying drawer space. What is needed is an inexpensive movable storage container having an item storage region therein that can be positioned under a bed and mounted easily to a leg of the bed.

According to the present invention, a storage container is provided for use under a piece of furniture having at least one leg. The container includes a container frame, a basket having an item-storage region therein mounted on the frame for movement therewith, and means for hinging the frame to the leg so that the frame and basket are movable as a unit relative to the piece of furniture about the leg.

In preferred embodiments of the present invention, two pie-shaped storage containers are provided and arranged to lie next to one another under a bed. One of the containers is attached to one leg at the head board and the other container is attached to another leg at the foot board. Each container is hinged to one of the legs using a strap which extends outwardly from the frame and wraps around the leg so that frame may pivot about the leg. This pivoting allows a user to move the item-storage region in the frame from a retracted position underneath the bed to a position where the item-storage region is exposed and no longer hidden underneath the mattress on the bed and can be used. It will be understood that storage containers in accordance with the present invention could have other shapes and be mounted on pieces of furniture other than beds.

The container frame itself is pie-shaped and includes two U-shaped legs bound at one end forming a 90° angle and a curved basket-support leg interconnecting the two other ends. The curved basket-support leg is elevated above the bottom portions of the U-shaped legs so that the basket can be mounted onto the pie-shaped frame. Illustratively, the basket is composed of netting or other material which is attached to both the basket-support leg and to the bound upstanding ends of the U-shaped leg members.

A fabric seam extends around the circumference of the netting and binds the boarder of the netting to its middle section creating a type of sleeve. Three such sleeves are formed in the netting. One sleeve portion extends around the curved basket-support leg to mount the basket onto the frame. Another sleeve extends along the length of one of the U-shaped legs from the bound upstanding ends to the elevated curved basket-support leg. The other sleeve extends along the second U-shaped leg from the bound upstanding ends to the elevated curved basket-support leg. The two sleeves which extend along the lengths of the U-shaped legs form a taut upper fabric edge.

Inverted pockets are formed in the netting at points where stitching in the fabric seam is discontinued thereby creating a flap. Three such inverted pockets are formed in the netting. One pocket extends over the upstanding ends of the U-shaped leg members to mount the basket onto the frame. The other two inverted pockets are positioned along the length of the curved basket-support leg, one at each of the opposite ends of the sleeve portion containing the basket-support leg.

From a manufacture's perspective, a storage container in accordance with the present invention is preferable over traditional storage containers because the container's shape allows for fast and inexpensive tooling. This shape also permits the manufacturer to use a very small carton for storing and shipping the container thus reducing both warehouse and transportation expense. Moreover, it is easy to paint the container frame to match the color of any previously manufactured bed leg and to mount the hinge strap, which extends from the frame, on a variety of bed legs.

A user of a storage container in accordance with the present invention will also find that a container in accordance with the present invention is preferable over traditional storage container. The container's light weight frame glides on the floor as the container is pivoted on the leg making it easier to use than traditional storage containers. Furthermore, the container is readily accessible to the user because it is attached to a bed leg of the user's choice.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
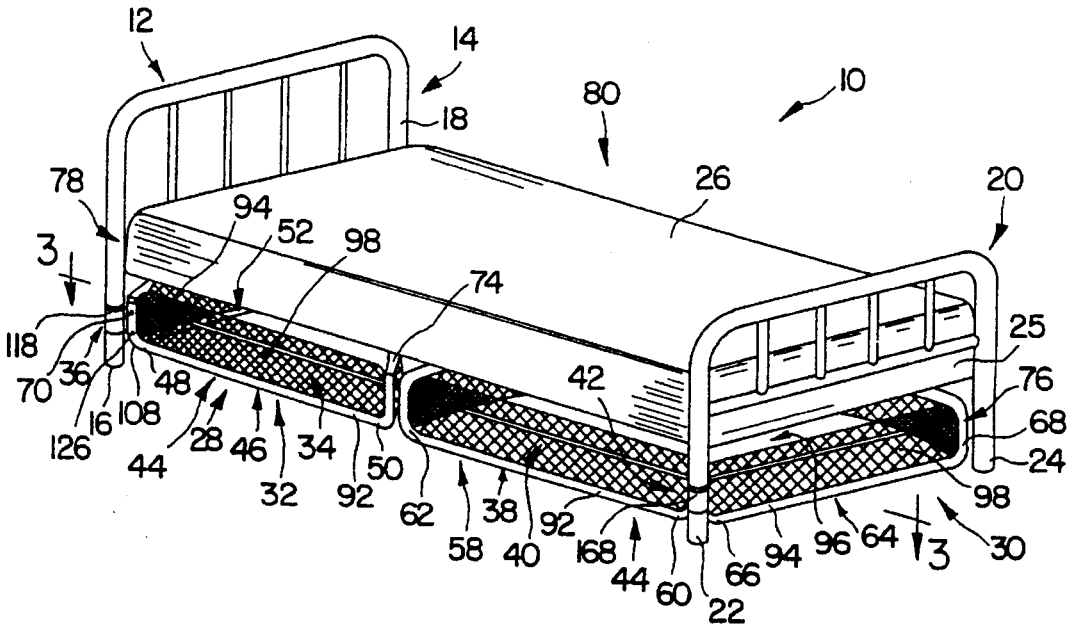
FIG. 1 is a perspective view of a bed having four legs and a matched pair of pie-shaped storage containers, each storage container being hinged to one of the bed legs for pivotable movement thereabout and pivoted to its retracted position underneath the bed.

A storage container 10 in accordance with the present invention is positioned to lie under a bed 12 having a head board 14 having a left leg 16 and a right leg 18, a foot board 20 having a left leg 22 and a right leg 24, and a support frame 25 extending between the head board 14 and the foot board 20. The support frame 25 holds a mattress 26. The storage container 10 includes a left container 28 and a right container 30. The left container 28 has a frame 32, a basket 34 mounted on the frame 32 for movement therewith, and a strap 36 for hinging the frame 32 to the left leg 16 of the head board 14. The right container 30 has a frame 38, a basket 40 mounted on the frame 38 for movement therewith, and a strap 42 for hinging the frame 38 to the left leg 22 of the foot board 20.

The bed 12 is configured to receive the containers 28, 30 in a retracted position 44 under the support frame 25 as shown in FIG. 1. The left container frame 32 is formed to include a first side leg 46 having a foot portion 48 and a head portion 50 and a second side leg 52 having a foot portion 54 and a head portion 56. The right container frame 38 is formed to include a first side leg 58 having a foot portion 60 and a head portion 62 and a second side leg 64 having a foot portion 66 and a head portion 68. The foot portions 48, 60 of the first side legs 46, 58 are coupled to the foot portions 54, 66 of the second side legs 52, 64 respectively. The foot portions 48, 54 are coupled together by a locking screw 70 and the foot portions 60, 66 are coupled together by a locking screw 72. Each of the foot portions 48, 54 and 60, 66 are coupled together by either a pin, a rivet, a rod, an adhesive, or comparable coupling means.

Figure 2:
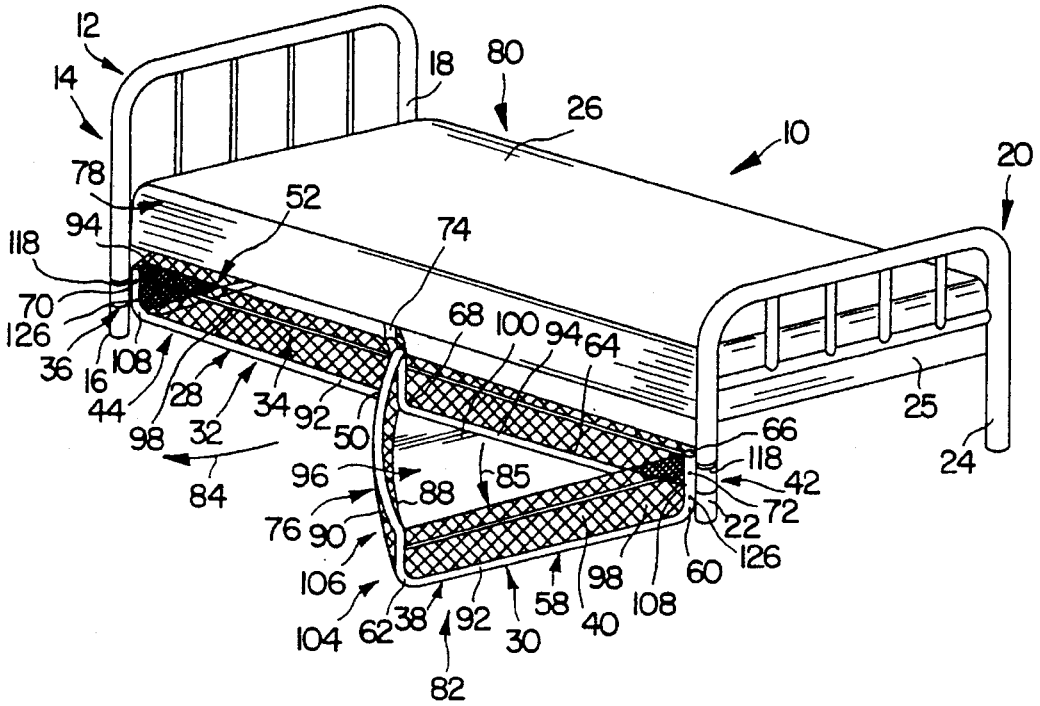
FIG. 2 is a view similar to FIG. 1 showing the right side storage container after it has been pivoted about one of the bed legs to an exposed position.
Figure 3:
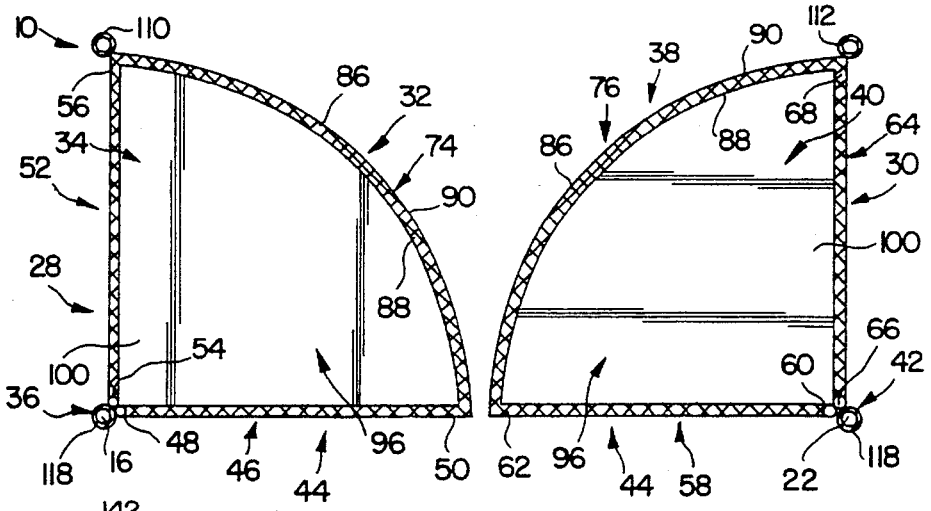
FIG. 3 is a view taken along line 3—3 of FIG. 1 showing the left-side and right-side baskets in their position underneath the bed and between the four bed legs.

The head portion 62 of the first side leg 58 is positioned in spaced-apart relation to the head portion 68 of the second side leg 64 as shown in FIGS. 1–3. A curved basket-support leg 74 interconnects the head portions 50, 56 of the first and second side legs 46, 52. A curved basket support leg 76 is interconnects the head portions 62, 68 of the first and second side legs 58, 64. The curved basket-support legs 74, 76 are formed to include a central aperture 77 having a cross-section sized for insertion and mounting of the head portions 50, 56, and 58, 64 therein. The basket-support leg 76 interconnects the first and second side legs 46, 52, and 58, 64, and is fixed in place using either a pin, rivet, rod, adhesive, or comparable connection means.

The bed 12 includes a front side 78 and a back side 80. Ideally, the left leg 16 of the head board 14 and the left leg 22 of the foot board 20 are positioned on the front side 78 and on opposite ends of the mattress 26. The rights legs 18, 24 are positioned along the back side 80 of the bed 12. The containers 28, 30 are mounted to each of the left legs 16, 22 on the front side 78 by straps 36, 42 extending outward from each of the frames 32, 38 respectively. The strap 36 extends around the left leg 16, and the strap 42 extends around the left leg 22 thereby mounting the containers 28, 30 under the mattress 26.

The head portion 50, 62 of the first side legs 46, 58, in the retracted position 44, extend at about a 180° angle across the front side 78 of the bed 12 as shown in FIGS. 1 and 3. The head portions 56, 68 of the second side legs 52, 64 extend toward the back side 80 at about a 90° angle relative to the front side 78. The head portions 56, 68 of the second side legs 52, 64 abut the right legs 18, 24 respectively which are positioned on a back side 80 of the bed 12.

The storage container 10 is further formed for manual extension to an exposed position 82 as shown in FIG. 2. Each frame 32, 38 is formed for pivotable movement 84, 85 between the retracted position 44 and the exposed position 82 on the left legs 16, 22, respectively. The frame 32 pivots 84 on the left leg 16 from the retracted position 44 and the frame 38 pivots 85 on the left leg 22 from the retracted position 44. In the exposed position 82, the head portion 68 of the second side leg 64 extends at about a 180° angle across the front side 78. The head portion 62 of the first side leg 58 extends in a direction opposite the back side 80 at about a 90° angle relative to the front side 78. The second side leg 64 extends across the front side 78 and the first side leg 58 extends outward at about a 90° angle relative to front side 78.

The basket-support legs 74, 76 as shown in FIGS. 2 and 3 each have a curved portion 86 with a concave side 88 arranged to face the respective foot portions 48, 54 and 60, 66 of the first and second side legs 46, 52 and 58, 64 and a convex side 90 arranged to face the back side 80 in the retracted position 44. Each of the first side legs 46, 58 has a straight shaft 92 interconnecting the foot 48, 60 and head 50, 62 portions. Each of the second side legs 52, 64 has a second straight shaft 94 interconnecting the foot 54, 66 and head 56, 68 portions.

Furthermore, the baskets 36, 40 are each formed to include an item-storage region 96 therein. Ideally, the item-storage region 96 is defined by netting 98 that is positioned to extend between the basket-support legs 74, 76 and the foot portions 48, 54 and 60, 66. The netting 98 includes a fabric floor portion 100 positioned in the item-storage region 96 forming a flexible insert 102.

Each of the first and second side legs 46, 52 and 58, 64 are fixed to lie at right angles to one another as shown in FIGS. 1–4. The straight shafts 92, 94 lie in a first plane 104 and the basket-support legs 74, 76 are elevated to lie in a second plane 106 vertically above the first plane 104. Each of the foot portions 48, 54 and 60, 66 have upstanding ends 108 extending vertically above the first plane 104. Preferably, the upstanding ends 108 are elevated to lie in the second plane 106. Each of the head portions 50, 56 and 62, 68 may also extend vertically upward from the first plane 104 toward the second plane 106. Each of the head portions 50, 56 and 62, 68 may further lie in the first plane 104 engaging the basket-support legs 74, 76 in the first plane 104.

The straps 36, 42 are formed for hinging the frames 32, 38 to the legs 16, 22 so that the frames 32, 38 and the baskets 34, 40 are movable a units about the legs 16, 22. The strap 42 allows a user to pivot 85 the frame on the left bed leg 22 between the positions shown in FIGS. 1 and 2. A back strap 110 may further be mounted between the head portion 56 and the basket-support leg 74 so that the frame 32 and the basket 34 are movable as a unit about the right leg 18. A second back strap 112 may be mounted between the head portion 68 and the basket-support leg 76 so that the frame 38 and the basket 40 are movable as a unit about the right leg 24.

The straps 36, 42 include opposite ends 114, 116 and a wrapping portion 118 extending therebetween. Each of the opposite ends [14, 116 are positioned adjacent to one another forming a loop 120 sized for extension of one of the left legs 16, 22 therethrough. The left legs 16, 22 may each be fixed to a stabilizer 122 to prevent the legs 16, 22 from slipping on a surface. The length of the wrapping portion 118 may be expanded to increase the diameter of the loop 120 thus accommodating extension of various diameter legs 16, 22 therethrough.

Figure 4:
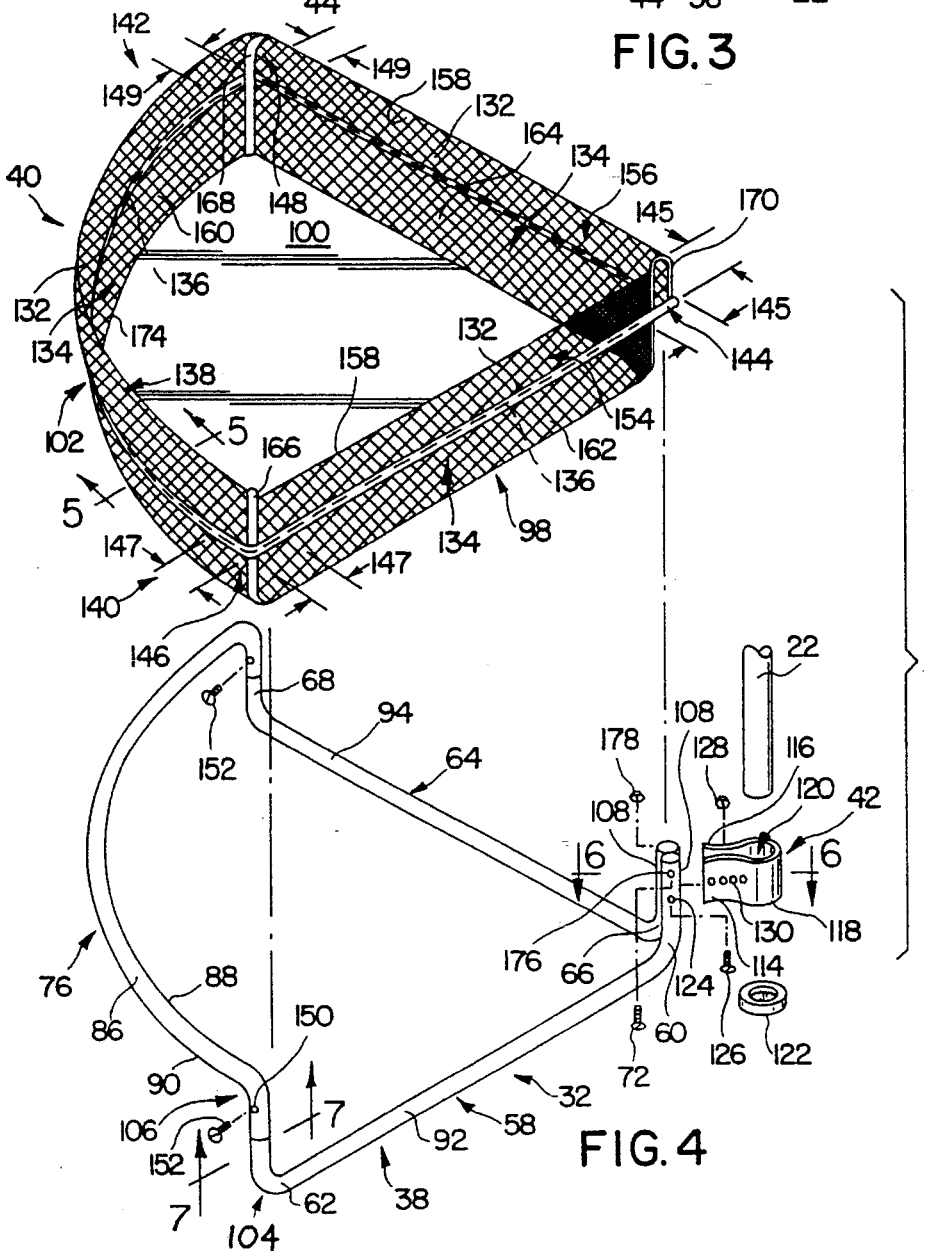
FIG. 4 is an exploded, perspective view of the storage container of FIG. 1 showing the frame, the basket as it is about to be mounted on the frame, and a strap formed to loop around one of the bed legs to hinge the basket-supporting frame on the leg.

As shown in FIG. 4, the strap 42 is formed for engagement with the foot portions 60, 66. The foot portions 60, 66 each include an cavity 124 sized for extension of a frame screw 126 having a nut 128 therethrough. The strap 42 is formed to include slots 130 extending from the opposite ends 114, 116 toward the wrapping portion 118. The frame screw 126 is formed for extension through one of the slots 130 in one opposite end 114 and one of the slots 130 in the other opposite end 116 for binding the strap 42 to the frame 38. The length of the wrapping portion 118 may be expanded by extending the frame screw 126 through the slots 130 positioned nearest the opposite ends 114, 116.

The netting 98 includes a border portion 132, an interior portion 134, and a fabric seam 136. The fabric seam 136 couples the border portion 132 to the interior portion 134 so that the basket-support 76 leg may extend therethrough. The border portion 132 is further formed to be mounted on the foot portions 60, 66.

The fabric seam 136 forms a sleeve portion 138 having first and second ends 140, 142. The fabric seam 136 extends from the first end 140 to the second end 142. The basket-support leg 76 is formed for extension through the sleeve portion 138, in order to mount the basket 40 on the basket-support leg 76. The fabric seam 136 also forms a pocket portion 144 having a width 145 so that upstanding ends 108 may extend into the pocket portion 144 for engagement and interaction with the border portion 132.

Figure 7:
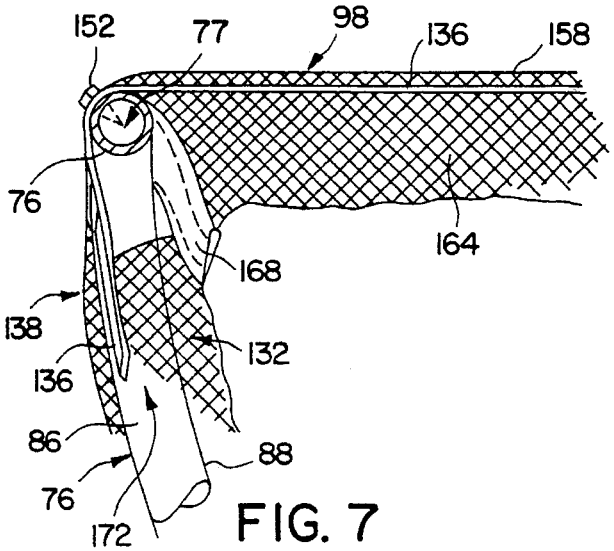
FIG. 7 is a view taken along line 7—7 of FIG. 4 (after assembly of the basket onto the frame as shown in FIG. 1) showing the basket netting engaging one of the basket support legs and extension of the basket netting downward therefrom to form a wall and a taut upper fabric edge of the basket netting forming a second wall of the basket.

In preferred embodiments, the netting 98 has three pocket portions 144, 146, 148. One pocket portion 146 having a width 147 is positioned at the first end 140 of the sleeve portion 138 and another pocket portion 148 having a width 144 is positioned at the second end 142. The basket-support leg 76 is formed to include a hole 150 in each of the first and second ends 140, 142. The netting 98 is formed for attachment to the basket-support leg 76 by a locking pin 152. As shown in FIG. 7, the locking pin 152 extends through the border portion 132 and through the hole 150 into the basket-support leg 76 to secure the netting 98 onto the frame 38.

Furthermore the netting 98 has three sleeve portions 138, 154, 156. One sleeve portion 154 extends from the pocket portion 144 containing the foot portions 60, 66 along the length of the first side leg 58 toward the first end 140 of the sleeve portion 138 formed to contain the basket-support leg 76. The second sleeve portion 156 extends from the pocket portion 144 along the length of the second side leg 64 toward the second end 142. Ideally, the sleeve portions 154, 156 extend from the pocket portion 144 to the pocket portions 146, 148 positioned at the ends 140, 142 of the sleeve portion 138. The two sleeve portions 154, 156 each form a taut upper fabric edge 158.

The interior portion 134 of the netting 98 includes three wall portions 160, 162, 164. One wall portion 160 extends downward from the sleeve portion 138 formed to contain the basket-support leg 76. A second wall portions 162 extends downward from the sleeve portion 154 and a third wall portion 164 extends downward from the sleeve portion 156. Three interior seams 166, 168, 170 are positioned to extend from the border portion 132 in the pocket portions 144, 146, 148, respectively, to the fabric floor portion 100 in order to couple the three wall portions 160, 162, 164 together.

Figure 5:
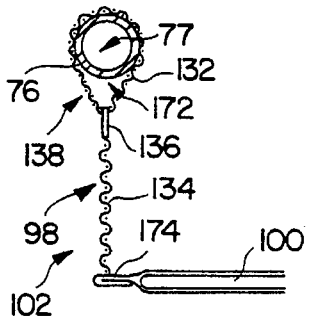
FIG. 5 is a view taken along line 5—5 of FIG. 4 (after assembly of the basket onto the frame as shown in FIG. 1) showing the position of a curved leg of the frame in a curved leg-receiving loop formed in the basket, a vertical side wall of the basket, and a horizontal floor of the basket.

The sleeve portion 138 is formed to include an aperture 172 sized for extension of the basket-support leg 76 therethrough as shown in FIG. 5. The basket-support leg 76 extends through the aperture 172 engaging and interacting with the border portion 132. The fabric floor portion 100 is mounted to the interior portion 134 of the netting 98 by a floor seam 174.

Figure 6:
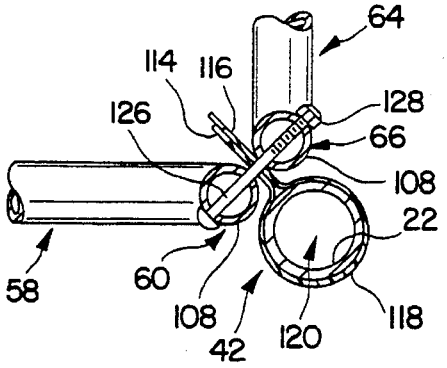
FIG. 6 is a view taken along line 6—6 of FIG. 4 (after assembly of the hinge strap onto the frame as shown in FIG. 1) showing one of the bed legs in the leg-receiving portion of the hinge strap and attachment of the hinge strap to the frame using a bolt arranged to hold two of the frame sections together.

Ideally, the strap 42 extends between the foot portions 60, 66 and the leg 22 extends through the loop 120, as shown in FIG. 6. The strap 42 is bound to the foot portions 60, 66 by a frame screw 126 extending through the foot portions 60, 66 and through the strap 42. The frame screw 126 is locked to the foot portions 60, 66 by the nut 128. Furthermore, the length of the wrapping portion 118 may be expended to form a loop 120 having an intermediate diameter by extending the frame screw 126 through a slot 130 positioned near one opposite end 114 and through a slot 130 positioned further away from the other opposite end 116. Additional methods for expanding the length of the strap 42 may include using a belt or an elastic strap.

In use, the storage container 10 is assembled in the following manner. The user connects the foot portions 60, 66 of the first and second side legs 58, 64 together by extending a locking screw 72 through a locking hole 176 and binding the locking screw 72 with a locking nut 178 so that the head portions 62, 68 are in spaced-apart relation to one another as shown in FIG. 4. The user then inserts the basket-support leg 76 through the aperture 172 formed in the sleeve portion 138 of the netting 98 so that basket-support leg 76 extends outwardly from the first and second ends 140, 142 of the sleeve 138. The user then positions the basket-support leg 76 onto the head portions 62, 68 and pushes the head portions 62, 68 into the central aperture 76 so that the basket-support leg 76 interconnects the head portions 62, 68.

The netting 98 which is coupled to the basket-support leg 76 is then pulled toward the foot portions 60, 66 and the pocket portion 144 of the netting 98 is placed over the upstanding ends 108. The netting 98 is then mounted on the frame 38 forming two taut upper fabric edges 158 extending from the upstanding ends 108 to the basket-support leg 76. The netting 98 may further be secured to the frame 38 by extending locking pins 152 through the netting 98 and basket-support leg 76.

Alternatively, the foot portions 60, 66 of the first and second side legs 58, 64 may be connected following the placement of the pocket portion 144 over the upstanding ends 108. The user may then place the locking screw 72 through the netting 98 and the foot portions 60, 66 securing the netting 98 on the frame 38.

The frame 38 is mounted under the bed 12 in the following manner. The user extends the wrapping portion 118 of the strap 42 around a bed leg 22 and positions the opposite ends 114, 116 adjacent one another forming a loop 120 through which the leg 22 extends as shown in FIGS. 4 and 6. The opposite ends 114, 116 are then placed between the upstanding ends 108 and a frame screw 126 is inserted through the cavity 124 formed in the first side leg 58, through the slots 130 in the opposite ends 114, 116 and through the cavity 124 formed in the second side leg 64. The frame screw 126 is locked in position by the nut 128.

It is easy to install one or more storage containers 10 in accordance with the present invention on virtually any bed or furniture leg. A user must simply wrap the adjustable strap around the leg of choice and attach the ends of that strap to the container frame. If it becomes necessary at a later date to move the container to another leg on the bed or to another piece of furniture, the user must simply disconnect the strap from the frame and reinstall the container at the new location.

Once installed, the storage container is used by pivoting the light weight container frame out from under the bed. The container frame glides on the floor as the storage container is pivoted. This gliding motion enables the user to easily move a container whose item-storage region is full out from under the bed.

Although the invention has been described in detail with reference to certain preferred embodiments, variations and modifications exist within the scope and spirit of the invention as described and defined in the following claims.

We claim:

1. A movable storage container for use under a piece of furniture having at least one leg, the container comprising a container frame, a basket mounted on the frame for movement therewith and formed to include an item storage region therein, and a hinge formed to pivot about an axis of a leg of a piece of furniture and coupled to the container frame so that the frame and basket are movable as a unit relative to the piece of furniture about the leg.

2. The container of claim 1, wherein the frame includes a first side leg having foot and head portions, a second side leg having a foot portion coupled to the foot portion of the first leg and a head portion situated to lie in spaced-apart relation to the head portion of the first side leg, and means for interconnecting the head portions of the first and second side legs.

3. The container of claim 2, wherein the basket is netting positioned to extend between the interconnecting means and the foot portions of the first and second side leg.

4. The container of claim 2, wherein the hinge includes a strap having opposite ends and a wrapping portion extending therebetween.

5. The container of claim 3, wherein the netting is formed to include a border portion, an interior portion, means for coupling the border portion to the interconnecting means, and means for mounting the border portion on the foot portions of the first and second leg.

6. The container of claim 5, wherein the interconnecting means is a basket support leg, the coupling means is a sleeve portion, the sleeve portion includes opposite ends and fabric means extending from one opposite end to the other opposite end forming an aperture sized for extension of the basket support leg therethrough, and the mounting means is a pocket portion extending over the foot portions of the first and second members.

7. The container of claim 6 having three pocket portions, one pocket portion being positioned at each of the opposite ends of the sleeve portion, and the basket support leg extends through the sleeve portion and is coupled to the netting in each of the two pocket portions.

8. The container of claim 6 having three sleeve portions, two of the sleeve portions each extend from the pocket portion containing the foot ends along the length of the side leg members toward the basket support leg, and the two sleeve members form an upper fabric edge.

9. The container of claim 8, wherein the interior portion includes three wall portions, one of the wall portions extends downward from the sleeve portion containing the engaging means, and two other of the wall portions each extend downward from the upper fabric edge.

10. The container of claim 1, wherein the basket is includes netting having a border portion, an interior portion, and fabric means for coupling the border portion to the frame.

11. The container of claim 1, wherein the hinge has opposite ends and a wrapping portion extending therebetween.

12. A storage container system for a piece of furniture having a support frame the system comprising a pivot leg including means for supporting a piece of furniture, a container frame, a basket mounted on the frame for movement therewith and formed to include an item-storage region therein, and a strap having opposite ends and a wrapping portion extending therebetween to form a loop between the frame and the wrapping portion, the strap being coupled to the container frame, and means for expanding the length of the wrapping portion to increase the diameter of the loop to accommodate the extension of legs of differing size therethrough.

13. The system of claim 12, wherein the basket is a netting positioned to extend between the basket support leg and the foot portions of the first and second leg, and the netting extends over the foot portions mounting the netting on the frame.

14. The system of claim 12, wherein the expansion means includes slots formed in each of the opposite ends, and the frame screw extends through at least one slot in each opposite ends.

15. A movable storage container for use under a piece of furniture having at least one leg, the container comprising a container frame having a first side leg having foot and head portions, a second side leg having a foot portion coupled to the foot portion of the first leg and a head portion situated to lie in spaced-apart relation to the head portion of the first side leg, and a basket support leg engaging the head portions of the first and second side leg, the foot portions have upstanding ends, and the first side leg and the second side leg are fixed to lie at right angles to one another, a basket mounted on the frame for movement therewith and formed to include an item storage region therein, the basket including netting having an interior portion, a border portion, and seam means for coupling the border portion to the interior portion forming a sleeve having an aperture and a pocket portion, and the basket support leg extends through the aperture, and the upstanding ends extend into the pocket portion, and means for hinging the frame to a leg of a piece of furniture so that the frame and basket are movable as a unit relative to the piece of furniture about the leg.

16. A movable storage container for use under a piece of furniture having at least one leg, the container comprising a container frame, a basket mounted on the frame for movement therewith and formed to include an item storage region therein, and means for hinging the frame to a leg of a piece of furniture so that the frame and basket are movable as a unit relative to the piece of furniture about the leg, and the hinging means is a strap having opposite ends and a wrapping portion extending therebetween and the opposite ends include means for expanding the length of the wrapping portion.

17. A movable storage container for use under a piece of furniture having at least one leg, the container comprising a container frame, a basket mounted on the frame for movement therewith and formed to include an item storage region therein, the basket including netting having a border portion, an interior portion, fabric means for coupling the border portion to the frame, a fabric floor portion and means for fixing the interior portion to the floor portion forming a flexible insert, and means for hinging the frame to a leg of a piece of furniture so that the frame and basket are movable as a unit relative to the piece of furniture about the leg.

18. A movable storage container for use under a piece of furniture having at least one leg, the container comprising a container frame, a basket mounted on the frame for movement therewith and formed to include an item storage region therein, the basket including netting having a border portion, an interior portion, a fabric seam forming a sleeve portion and a pocket portion between the border portion and the interior portion and the frame extends through the sleeve portion and into the pocket portion mounting the border portion onto the frame, and means for hinging the frame to a leg of a piece of furniture so that the frame and basket are movable as a unit relative to the piece of furniture about the leg.

19. The container of claim 18, wherein the sleeve portion includes opposite ends and the fabric seam extends from one opposite end to the other opposite end forming an aperture sized for extension of the frame therethrough.

20. The container of claim 19 having three sleeve portions, one of the sleeve portion extends from the pocket portion toward one opposite end of the sleeve portion sized for insertion of the frame therethrough, another of the sleeve portion extends from the pocket portion toward the other opposite end, and the two sleeve members form an upper fabric edge.

21. The container of claim 20, wherein the interior portion includes three wall portions, one of the wall portions extends downward from the sleeve portion containing the frame, and two other of the wall portions each extend downward from the upper fabric edge.

22. The container of claim 19 having three pocket portions, one pocket portion being positioned at each of the opposite ends of the sleeve portion, and the frame extends through the sleeve portion and is coupled to each of the two pocket portions.

23. A movable storage container for use under a piece of furniture having at least one leg, the container comprising a container frame having a first side leg having foot and head portions and a straight shaft interconnecting the head and foot portions, a second side leg having a foot portion coupled to the foot portion of the first leg, a head portion situated to lie in spaced-apart relation to the head portion of the first side leg and a straight shaft interconnecting the head and foot portions, and means for interconnecting the head portions of the first and second side legs, the interconnecting means including a basket support leg having a curved portion and a concave side arranged to face toward the foot portions of the first and second side leg, the first and second side leg are fixed to lie at right angles to one another, the straight shafts of the first and second side leg lie in a first plane, and the curved basket support leg is elevated to lie in a second plane vertically above the first plane, a basket mounted on the frame for movement therewith and formed to include an item storage region therein, and means for hinging the frame to a leg of a piece of furniture so that the frame and basket are movable as a unit relative to the piece of furniture about the leg.

24. The container of claim 23 wherein the foot portions of the first and second side leg are upstanding ends.

25. The container of claim 23, wherein the upstanding ends are elevated to lie in the second plane.

26. The container of claim 23, wherein the basket includes a sleeve portion and a pocket portion, the basket support leg extends through the sleeve portion, and the upstanding ends extend into the pocket portion.

27. A storage container system for a piece of furniture having a support frame, the system comprising a pivot leg including a bottom end for supporting a piece of furniture on a surface, a container frame having side legs each including a straight shaft positioned substantially co-planer with the bottom end and resting on the surface, a basket mounted on the frame for movement therewith and formed to include an item-storage region therein, and means for pivoting the container frame on the pivot leg, the pivoting means being coupled to the container frame.

28. The system of claim 27, wherein the container frame includes a first side leg having foot and head portions, a second side leg having a foot portion coupled to the foot portion of the first leg and a head portion situated to lie in spaced-apart relation to the head portion of the first side leg, and a basket-support leg interconnecting the head portions of the first and second side leg.

29. The system of claim 28, wherein the pivoting means is coupled to the foot portions of the first and second side legs.

30. The system of claim 29, further comprising means for binding the pivoting means between the foot portions.

31. The system of claim 30, wherein the binding means includes a frame screw extending through the foot portions and through the pivoting means.

32. The system of claim 30, wherein the pivoting means includes opposite ends having slots and a wrapping portion extending therebetween, and the binding means extends through at least one slot in each opposite end.

33. The system of claim 27, wherein the pivoting means is a strap having opposite ends and a wrapping portion extending therebetween, the opposite ends are coupled to the frame forming a loop between the frame and the wrapping portion, and the leg extends through the loop.

34. A movable storage container for use under a piece of furniture having at least one leg, the container comprising a container frame including a first side leg having foot portion with an upstanding end and a head portion, a second side leg having a foot portion with an upstanding end coupled to the upstanding end of the foot portion of the first leg and a head portion situated to lie in spaced-apart relation to the head portion of the first side leg, and means for interconnecting the head portions of the first and second side legs, and the first and second side leg are fixed to lie at right angles to one another and the interconnecting means includes a basket support leg having a curved portion and a concave side arranged to face toward the foot portions of the first and second side leg, a basket mounted on the frame for movement therewith and formed to include an item storage region therein, and means for hinging the frame to a leg of a piece of furniture so that the frame and basket are movable as a unit relative to the piece of furniture about the leg.

35. A storage container system, the system comprising a piece of furniture having a mattress support frame and legs coupled to the mattress support frame, a pie-shaped swing frame pivotably mounted on one of the legs, the swing frame having a retracted position underneath the mattress support frame and an exposed position out from underneath the mattress support frame, and a basket mounted on the swing frame for movement therewith, the basket being formed to include an item-storage region therein which is covered by the mattress support frame when the basket and swing frame are moved to the retracted position.

36. The system of claim 35, wherein the furniture includes a front side, a back side, and opposite legs positioned on the front side, a pie-shaped frame having a basket support portion and a strap coupled to the basket support portion is mounted to each of the legs, the strap extends from the frame around the leg so that one swing frame pivots from the retracted position to the exposed position in a clockwise direction and the other swing frame pivots from the retracted position to the exposed position in a counter-clockwise direction.

37. The system of claim 35, wherein the pie-shape frame includes a first side leg having foot portion with an upstanding end and a head portion, a second side leg having a foot portion with an upstanding end coupled to the upstanding end of the foot portion of the first leg and a head portion situated to lie in spaced-apart relation to the head portion of the first side leg, and a basket support leg interconnecting the head portions of the first and second side legs.

38. The system of claim 37, wherein the head portion of the first side leg, in the retracted position, extends at about a 180° angle across the front side of the bed and the head portion of the second side leg extends toward the back side at about a 90° angle relative to the front side.

39. The system of claim 37, wherein the head portion of the second side leg, in the exposed position, extends at about a 180° angle across the front side of the bed and the head portion of the first side leg extends outward from the front side at about a 90° angle relative to the front side.

40. The system of claim 37, wherein the first side leg has a straight shaft interconnecting the head and foot portions, the second side leg has a straight shaft interconnecting the head and foot portions, and the foot portions of the first and second side leg are upstanding ends.

41. The system of claim 40, wherein the basket-support leg has a curved portion and a concave side arranged to face toward the upstanding ends of the first and second side leg.

42. The system of claim 41, wherein the basket-support leg is elevated to lie vertically above the straight shaft portions of the first and second side leg.

* * * * *